US005587043A

United States Patent [19]

Hying et al.

[11] Patent Number: 5,587,043

[45] Date of Patent: Dec. 24, 1996

[54] THIN LABEL APPLICATOR

[75] Inventors: Clement F. Hying, Menomonee Falls; Jack E. Perko, Cedarburg; Larry E. Wenzler, Oak Creek, all of Wis.

[73] Assignee: Brady USA, Inc., Milwaukee, Wis.

[21] Appl. No.: 462,298

[22] Filed: Jun. 5, 1995

[51] Int. Cl.[6] ..... B65C 9/00

[52] U.S. Cl. ..... 156/566; 156/361; 156/362; 156/542; 156/568; 156/DIG. 31

[58] Field of Search ..... 156/566, 361, 156/362, 541, 542, 568, DIG. 31, DIG. 38, 289

[56] References Cited

U.S. PATENT DOCUMENTS

| | | | |
|---|---|---|---|
| 4,029,537 | 6/1977 | Kish | 156/497 |
| 4,210,484 | 7/1980 | Crankshaw et al. | 156/542 |
| 4,242,167 | 12/1980 | Hoffmann | 156/357 |
| 4,253,902 | 3/1981 | Yada | 156/566 |
| 4,479,839 | 10/1984 | Tasma | 156/249 |
| 4,500,386 | 2/1985 | Hoffman | 156/449 |
| 4,561,921 | 12/1985 | Treiber | 156/297 |
| 4,566,933 | 1/1986 | Crankshaw et al. | 156/444 |
| 4,589,943 | 5/1986 | Kimball et al. | 156/256 |
| 4,612,076 | 9/1986 | Moss | 156/249 |
| 4,612,078 | 9/1986 | Karp | 156/493 |
| 4,619,726 | 10/1986 | Cook et al. | 156/366 |
| 4,648,930 | 3/1987 | La Mers | 156/247 |
| 4,726,865 | 2/1988 | Treat | 156/249 |
| 4,758,303 | 7/1988 | Shastko | 156/542 |
| 4,842,660 | 6/1989 | Voltmer et al. | 156/64 |
| 5,078,820 | 1/1992 | Hamamura et al. | 156/267 |
| 5,100,493 | 3/1992 | Leclere et al. | 156/285 |
| 5,102,485 | 4/1992 | Keeler et al. | 156/256 |
| 5,256,239 | 10/1993 | Voltmer et al. | 156/362 |
| 5,261,996 | 11/1993 | Rossini | 156/521 |
| 5,264,066 | 11/1993 | Lundell | 156/361 |
| 5,271,787 | 12/1993 | Hoffmann et al. | 156/268 |
| 5,300,160 | 4/1994 | Wilson et al. | 156/64 |

*Primary Examiner*—James Engel
*Attorney, Agent, or Firm*—Whyte Hirschboeck Dudek S.C.

[57] ABSTRACT

The present invention provides a label applicator for removing pressure-sensitive, very thin, sub-surface printed labels from a web and applying the labels to PCMCIA memory cards carried on a shuttle such that the labels are more reliably and exactly placed than conventional labelers. The label applicator includes a peel plate for removing the adhesive-backed labels from a web and a vacuum applicator drum for transferring the labels from the peel plate to an unlabeled article carried on the shuttle. The shuttle is provided with micrometers to separately adjust the position of the memory cards about three independent axes to allow greater precision in label placement. Placement of labels on the memory cards is also enhanced through the use of a number of sensors which determine relative positions of the labels on the transfer drum and the linearly moving shuttle so that rotation of the drum can be synchronized to match movement of the shuttle.

8 Claims, 3 Drawing Sheets

THIN LABEL APPLICATOR

BACKGROUND OF THE INVENTION

1. Field of the Invention

This invention relates generally to the field of thin label applicators, and more specifically, to a device for removing pressure-sensitive, very thin, subsurface printed labels from a label web and precisely applying the labels to articles, such as PCMCIA memory cards, carried on a linearly moving, reciprocating shuttle.

2. Description of the Related Art

Numerous types of label applicator devices are available and used in various industries for applying adhesive-backed labels to articles. The labels are typically provided on rolls of label tape on which the individual labels are spaced apart and removably attached to the tape, also referred to as a web or release liner, by an adhesive coated surface of the labels. Additionally, the labels may be preprinted on their nonadhesive, outwardly facing surfaces. A roll of label-bearing web is mounted on a reel and passed through a device which removes the individual labels from the release liner and applies them to articles passing by the device on a continuously moving conveyor. The empty tape is subsequently wound onto a take-up reel.

These mechanisms utilize various types of arrangements for removing the labels from the web, moving the labels into a labeling position and applying the labels to unlabeled articles. The most common method of removing adhesive-backed labels from a web is to bend the web away from the label so as to form a small radius shear line between the label and the web. The label is peeled off along the shear line by pulling the web and the label away from each other. Typically, mechanisms employing this procedure are provided with a surface around which the label bearing web is directed. As the web is passed around the surface, an acute angle is formed between the surface and the label such that the leading edge of the label passing over the surface is disengaged from the release liner. The adhesive coated surface of the leading edge is then contacted with the surface of a moving article carried on the conveyor such that further movement of the article by the conveyor peels the remainder of the label from the web and transfers it onto the article. A wiper or roller may also be employed to provide pressure to the nonadhesive side of the label, thus ensuring that the label is securely fastened to the article.

Alternatively, the label may be peeled completely from the web by a transfer device which subsequently moves the label into contact with an article moving along the conveyor. Typically, the transfer device draws a vacuum so that the nonadhesive coated surface of the label can be held against a vacuum screen or pad during transfer from the label pick-up position to the label dispensing position. The transfer device will engage the leading edge of the label as it is separated from the web. Further, movement of the transfer device may be used to separate the trailing portion of the label from the web. Once the transfer device has moved a label into contact with an article, the vacuum will be released so that the label adheres to the article. Additionally, a positive air stream may be applied to project the label onto the article.

These labeling mechanisms attempt to combine high application speeds, i.e., the rate at which labels can be applied to the articles, with accurate positioning of the labels on the articles. Unfortunately, application speed often must be traded for accuracy of placement of the labels. Positional discrepancy in label placement is common in labeling mechanisms, such that labels are not applied exactly to the portion of the article intended to receive the labels. This is especially true of labeling mechanisms used in combination with conveyor systems for moving articles. Although such discrepancies are satisfactory for large articles which do not require accurate label placement, small articles, such as memory cards, circuit boards, etc. require much more accurate placement. For example, Personal Computer Memory Card Industry Association (PCMCIA) cards are emerging for use in a full range of low-power, small-form, factor applications for personal computers. Because these cards are approximately the size of a credit card, label placement must be very accurate. Those skilled in the art recognize that the smaller the labels and the smaller the articles to be labeled, the greater the significance of accurate placement by the labeling device.

One method used to lessen accuracy discrepancies has been to employ sensors to regulate the speed of various components of label transfer systems. These sensors have been used to detect the speed of the label-bearing web as it moves through the system, the position of labels on the web, the leading edges of labels as they are detached from the web, the speed of transfer devices, the presence of labels and/or articles to be labeled and the speed of conveyors used to move articles. However, the effectiveness of these sensors has been limited because they fail to synchronize the transfer device and the conveyor based on the position of the label on the transfer device and the position of the article on the conveyor. Further, mechanisms which utilize sensors in this manner are not easily adapted for use with labels of varying size.

Therefore, a thin label applicator which utilizes a reciprocating article delivery system is desirable. The position of this system should be adjustable so that the positions of the article delivery system and the transfer device can be synchronized based on the position of labels carried on the transfer device. Further, a mechanism for adjusting the articles held by the article delivery system so that accuracy of label placement can be increased is also desirable. Lastly, the mechanism should rapidly dispense labels while at the same time maintaining a high degree of accuracy with respect to label placement.

SUMMARY OF THE INVENTION

The present invention provides a device for removing very thin labels from a web and applying the labels to an article carried on a shuttle such that the labels are more reliably and exactly placed than they are with conventional labelers. The device uses sensors to determine label position on a transfer drum so that the position of the drum can be synchronized to match the position of an adjustable, linearly moving shuttle which operates reciprocally to move articles to and from a labeling station. Additionally, the portion of the shuttle which engages the articles is separately adjustable about three independent axes to allow far greater accuracy in label placement than is presently known.

More specifically, the thin label applicator of this invention comprises a label dispensing roller on which a label-bearing web is carried; a peel plate around which the web is guided to remove labels from the web; a web take-up roller; a vacuum applicator drum for transferring labels to articles; a linearly moving, reciprocating shuttle for moving and positioning the articles to receive labels from the applicator drum; and first, second, third and fourth optic sensors for detecting the position of the drum, the position of the shuttle, the leading edge of each label as it separates adjacent the peel plate and the position of labels as they are held on the drum.

The peel plate reverses the direction of the web so that the leading edge of the label adjacent the plate separates from the web. As the leading edge of the label separates from the web, the vacuum drum engages the leading edge of the label and rotates in conjunction with the movement of the web such that the remaining portion of the label is separated from the web and engaged by the vacuum drum. The vacuum drum is then rotated to a position where the leading edge of the label is contacted with the unlabeled article carried by the shuttle. Finally, the rotation of the drum and the movement of the shuttle are synchronized so that the remaining portion of the label is transferred to article carried on the shuttle.

The sensors function to synchronize the transfer of labels to the applicator drum and the application of labels to articles to be labeled. Specifically, the first and second sensors determine when the drum and the shuttle are in a home position. The third sensor determines when the web mounted labels are in position to be picked up by the drum, and the fourth sensor verifies the position of labels on the drum for proper alignment with the article to be labeled. The fourth sensor is adjustable around the periphery of the drum to compensate for different label lengths.

The precision of this invention is due in part to the article transfer shuttle which is used to transport articles to and from the transfer station. The article is positioned on the shuttle face such that as the article moves adjacent to the applicator drum, the article is in position to receive a label. Further, the position of the article on the shuttle may be adjusted about the x-axis and the y-axis, as well as angularly about the z-axis, to enhance accurate placement of the label on the article.

BRIEF DESCRIPTION OF THE DRAWINGS

In the drawings which illustrate that which is presently regarded as the best modes for carrying out the invention.

DESCRIPTION OF THE PREFERRED EMBODIMENTS

In the detailed description of this invention, like numerals are employed to designate like parts throughout the same. Various items of equipment, such as fasteners, fittings, etc., are omitted so as to simplify the description. However, those skilled in the art will realize that such conventional equipment can be employed as desired.

Figure 1:
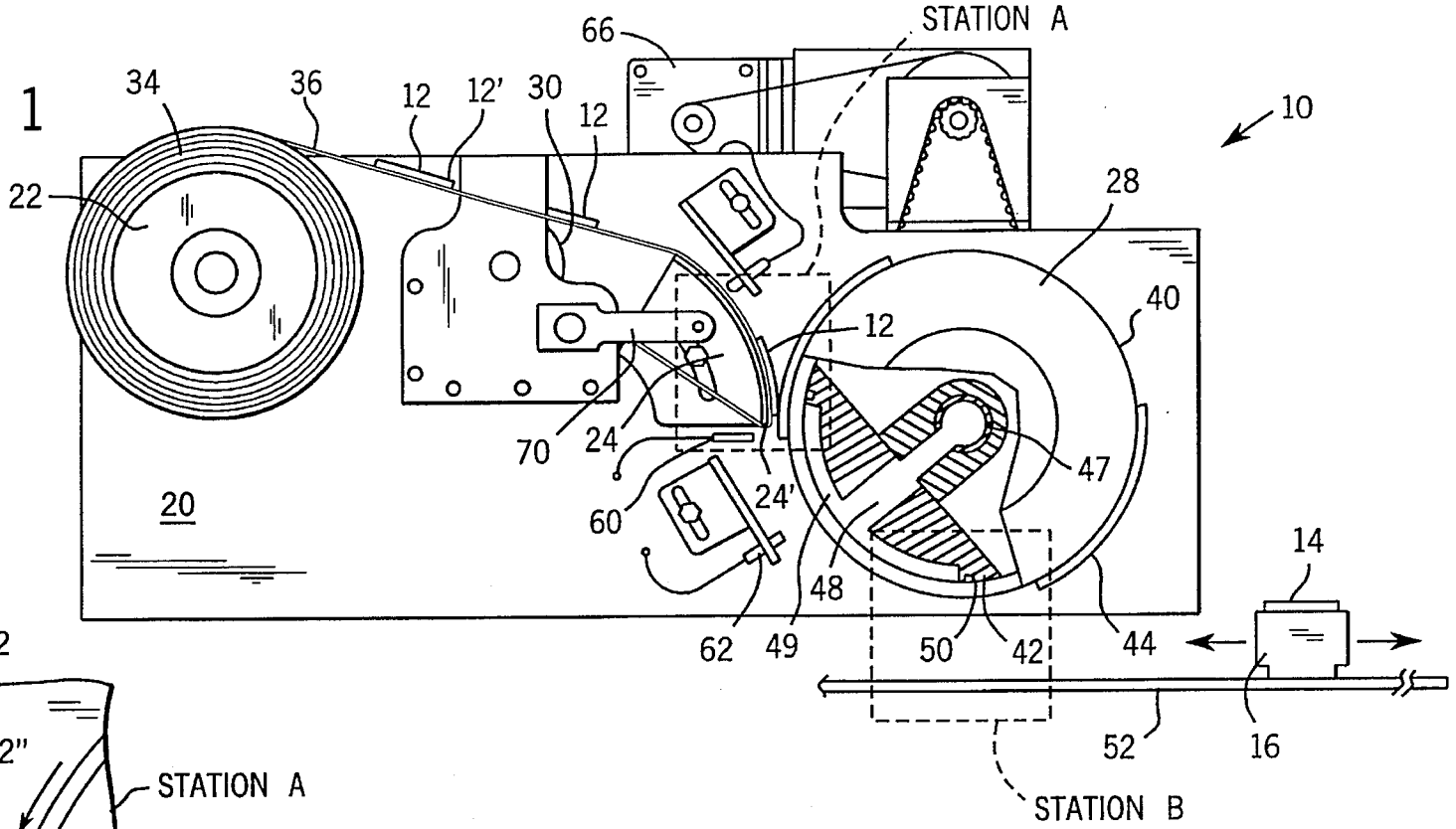
FIG. 1 illustrates a front view of the thin label applicator.
Figure 2:
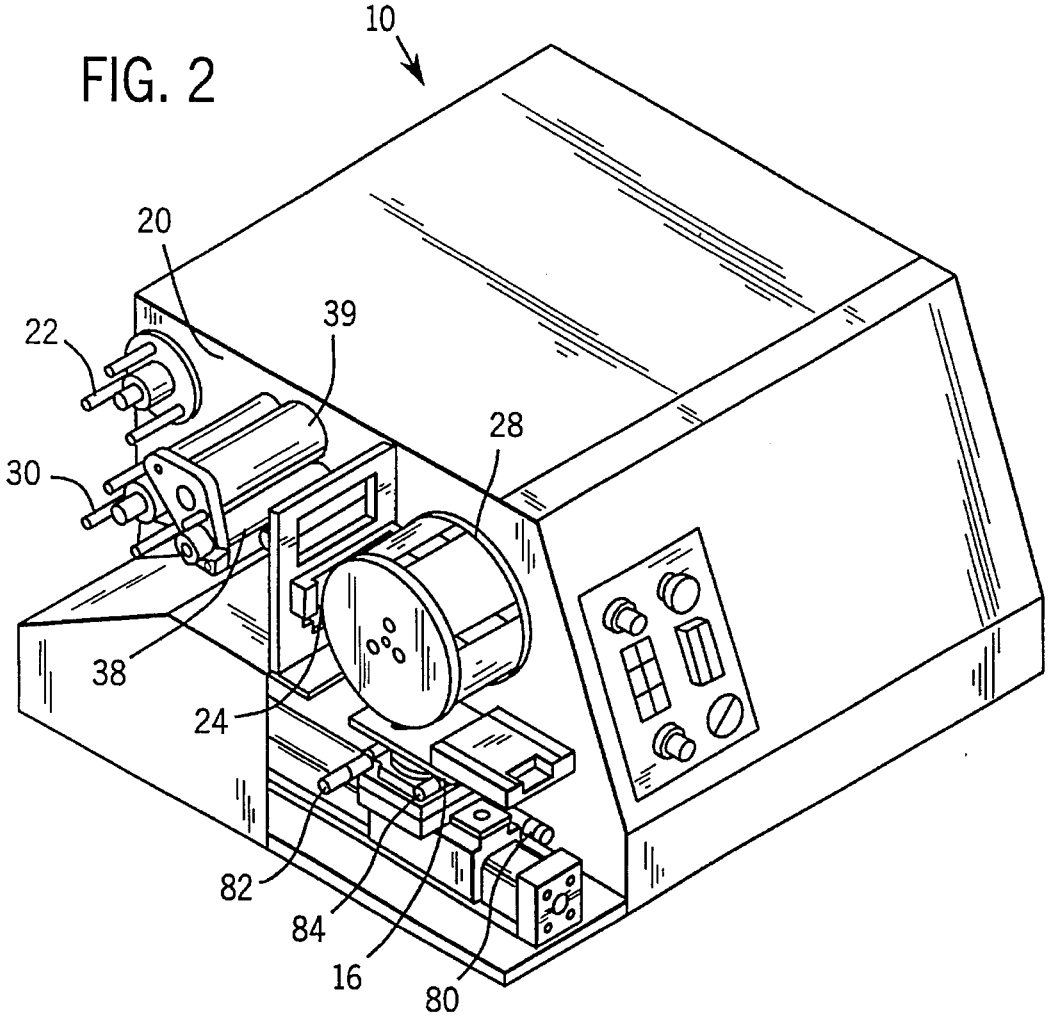
FIG. 2 illustrates a perspective view of the thin label applicator.

In FIG. 1, a preferred embodiment of the thin label applicator is shown and generally designated as 10. Applicator 10 applies thin or limp labels 12 to cylindrical or rectangular products shown typically as rectangular article 14 which is carried on shuttle 16. In FIG. 2, applicator 10 is shown without labels 12 or article 14. Shuttle 16 is disposed so that positioning of article 14 on shuttle 16 can be adjusted to enhance placement of label 12 on article 14. Placement of label 12 on article 14 is also enhanced through the use of a number of sensors (described below) which are used to verify the relative positions of different components of applicator 10. Although applicator 10 may be used to provide labels to a variety of articles having a variety of sizes, in the preferred embodiment, article 14 is shown as a flat, rectangularly shaped PCMCIA memory card whose dimensions are generally 2⅛ inches by 3⅜ inches by ⅛ inches. Additionally, although the invention can be used with pressure-sensitive labels of varying dimensions, the invention has been found to be especially useful in accurately applying pressure-sensitive, very thin, subsurface printed labels to PCMCIA cards. These labels are generally about 0.002 inches or less in thickness and sub-surface printed to protect the integrity of the labels.

Figure 3:
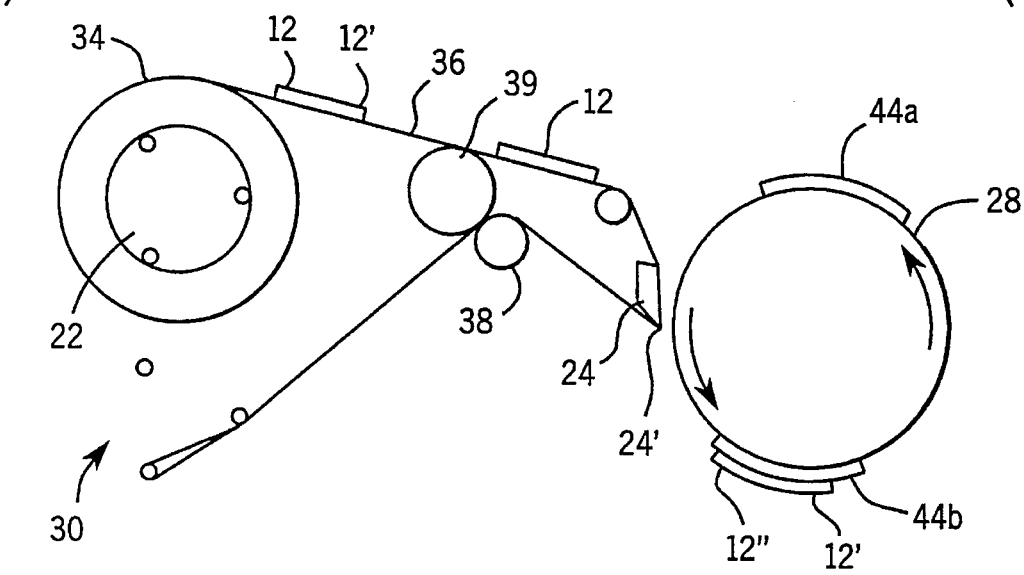
FIG. 3 illustrates a side view of the web and label path of the thin label applicator.

Applicator 10 comprises a support structure 20 on which is mounted an unwind roller 22, a peel plate 24, a vacuum applicator drum 28, a drive roller 39, a nip roller 38 and a take up roller 30. A label roll 34 is mounted on unwind roller 22. Label roll 34 is comprised of a web 36 on which adhesive-backed labels 12 are mounted. Web 36 is drawn from roll 34, over the top surface of peel plate 24, between drive roller 39 and nip roller 38 and onto take up roller 20. A brake mechanism 68 provides backward tension on web 36 between unwind roller 22 and peel plate 24, while drive roller 39 and nip roller 38 provide forward tension on web 36. The path of web 36 is illustrated in FIGS. 1A and 3.

Figure 1A:
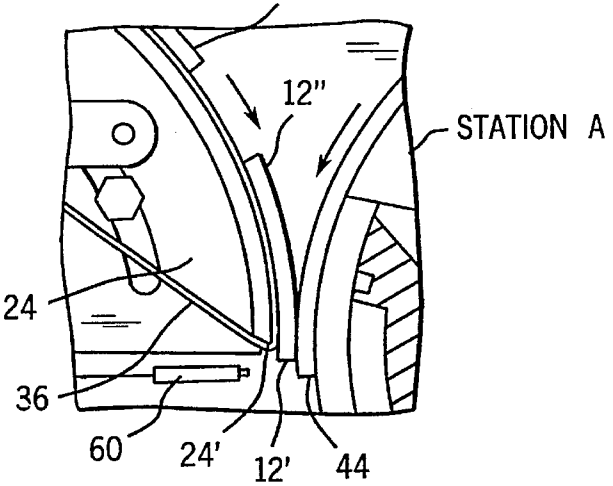
FIG. 1A illustrates a magnified side view of Station A shown in FIG. 1.

Peel plate 24 is used to cause the direction of web 36 to be reversed around front edge 24' of plate 24 so that a small radius shear line is formed between label 12 and web 36 (FIG. 1A). The leading edge 12' of label 12 is peeled off along the shear line by pulling web 24 away from label 12. Brake mechanism 68 is used to regulate the tension of web 36 above and below plate 24, and hence the shear force, so that the adhesive force at the shear line is less than the force required to bend label 12 around front edge 24'. Regulation of the shear force is necessary because the adhesive force may differ for various labels based on factors such as the thickness of the labels, the thickness of the liner, the physical and chemical characteristics of the adhesive compound itself, and wear on brake mechanism 68.

As leading edge 12' of label 12 separates from web 36, vacuum applicator drum 28 engages leading edge 12' such that rotation of applicator drum 28 in conjunction with the forward movement of web 36 causes the remaining portion of label 12 to separate from web 36. As shown in FIG. 1, vacuum applicator drum 28 is comprised of an exterior shell 40 rotatingly mounted on a stationary interior drum 42. Applicator pads **44*a*, 44*b* are mounted on the periphery of shell 40. Although two applicator pads are shown in the preferred embodiment, the number of pads may be increased or decreased depending on the particular labeling requirements of each applicator 10. Each applicator pad 44 is provided with a plurality of holes 46 which allow fluid communication between the interior drum 42 and the surface of pad 44. Disposed within drum 42 is vacuum means for drawing a vacuum in the interior of drum 42. Although many different techniques can be used for drawing a vacuum, in the preferred embodiment, vacuum shaft 47 is attached within drum 42 so that vacuum shaft 47 is in fluid communication with a stationary interior passageway 48 which extends radially outward and is itself in fluid communication with a slot 49 disposed partially around the exterior of interior drum 42. Slot 49 extends from a label pick-up station A (FIGS. 1 and 1A) to a label application station B so that a vacuum is maintained at the surface of pad 44 as it rotates from Station A to Station B. Stationary drum 42 is also provided with an air wiper 50** located adjacent Station B.

Linearly moving shuttle 16 is guided along shuttle track 52 which allows shuttle 16 to move reciprocally between Station B and an article pick-up/drop-off station (not shown). Shuttle 16 may be provided with any standard means for adjusting the position of article 14 on shuttle 16. In the preferred embodiment, micrometers 80, 82, 84 (FIG. 2) are used to position article 14 on shuttle 16 about the x-axis (parallel to travel of shuttle 16), the y-axis (perpendicular to travel of shuttle 16), and the rotational position about the z-axis, respectively. This allows precise placement of article 14 on shuttle 16 which is particularly desirable if article 14 is of a small size (and thus requiring more accurate label placement than larger articles) such as PCMCIA memory cards.

Figure 4:
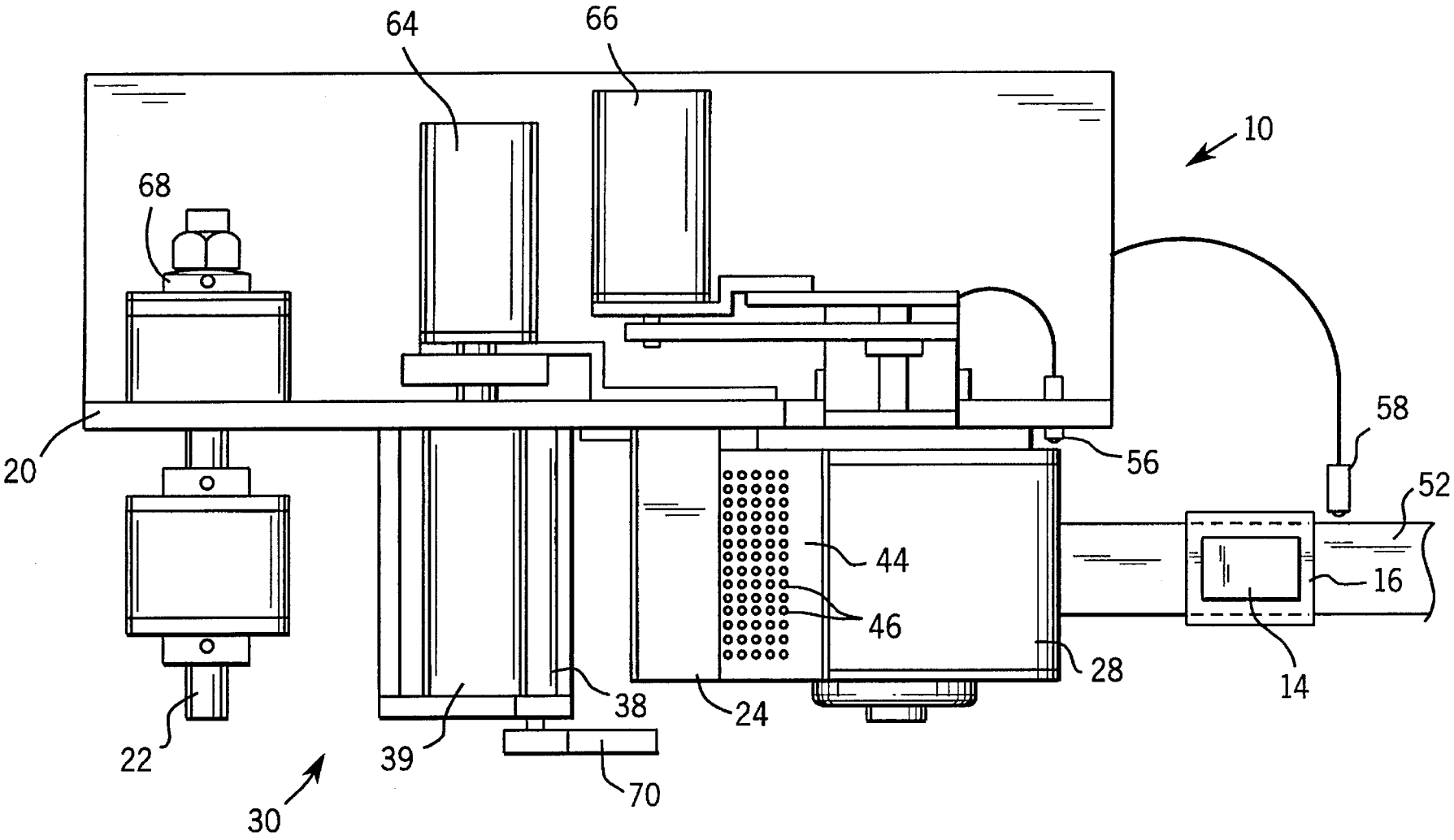
FIG. 4 illustrates a top view of the location of the optical sensors and the drive mechanisms for the thin label applicator.

The accurate application of labels 12 is further enhanced by a number of sensors which are used to coordinate relative positions of (1) label 12 as it moves adjacent peel plate 24; (2) applicator drum 28; (3) shuttle 16; and (4) label 12 on the surface of applicator pad 44. Referring specifically to FIGS. 1 and 4, a drum sensor 56 and a shuttle sensor 58 are used to detect when applicator drum 28 and shuttle 16, respectively, are in a home position, i.e., ready to receive a label. Another sensor, label feed sensor 60, is mounted adjacent front edge 24' of peel plate 24 (FIG. 1A) to verify that label 12 exits and to sense the leading edge 12' of label 12 as it separates from web 36. Finally, label placement sensor 62 verifies the position of label 12 on applicator pad 44 for proper alignment with article 14. In the preferred embodiment, label feed sensor 60 and label placement sensor 62 are reflective sensors which identify the presence and location, respectively, of labels by detecting the difference in contrast between the background, i.e., applicator pad 44, and the label. For example, when applicator pad 44 is in a home position at Station A to pick up label 12, the forward edge of applicator pad 44 is adjacent the leading edge 12' of label 12 which has separated from web 36, such that label 12 which is lightly colored, e.g. white, sharply contrasts with applicator pad 44 which is darkly colored, e.g. black. This contrast is detected by label feed sensor 60. Similarly, label placement sensor 62 can detect leading edge 12' or trailing edge 12" (FIG. 3) of label 12, and hence its placement on applicator pad 44, by detecting the color contrast at either edge of label 12 against the surface of applicator pad 44. Alternatively, both leading edge 12' and trailing edge 12" of label 12 can be detected to determine the length of label 12. This information can then be used to properly position shuttle 16 to receive label 12. Additionally, label placement sensor 62 is adjustable around the periphery of applicator drum 28 to compensate for different length labels. In the preferred embodiment, sensors 56 and 58 are through-beam sensors. All of the positional information generated by sensors 56, 58, 60, 62 can be processed by any standard controller (not shown) which can then synchronize movement of label web 36, applicator drum 28 and shuttle 16.

Rotation of applicator drum 28 and a take up roller 30 can be by any standard means such as electric motors 64 and 66, respectively, shown in FIG. 4.

Thin label applicator 10 is also provided with a friction brake mechanism 68 attached to unwind roller 22. Brake mechanism 68 functions to apply tension to (1) the portion of web 36 located between unwind roller 22 and peel plate 24 and (2) the portion of web 36 located between peel plate 24 and rollers 38, 39. As mentioned above, because brake 68 affects the tension of web 36 above and below peel plate 24, brake 68 can also be used to adjust the force along the shear line of web 36 as it bends around plate 24.

Nip roller 38 is tensioned to bear against drive roller 39 to advance web 36 around peel plate 24 and to maintain a forward tension on web 36 to counter the back tension created by brake 68. Nip roller 38 and drive roller 39 are provided for advancement in only one direction, i.e., the forward direction for advancement of web 36, so that brake 68 serves as the only means by which tension of web 36 can be adjusted. In one embodiment, nip roller 38 is provided with a nip tension handle 70 which permits nip roller 38 to be disengaged from drive roller 39 during loading and unloading of a label web.

The operation of thin label applicator 10 will now be described. As web 36 is pulled around peel plate 24 by take up roller 30, the leading edge 12' of label 12 moving around plate 24 separates from web 36 and is contacted by applicator pad 44 at Station A. Because a vacuum is drawn at the surface of applicator pad 44, the leading edge 12' of label 12 is drawn and held against applicator pad 44. As applicator drum 28 rotates in conjunction with the forward movement of web 36, the remaining portion of label 12 is peeled away and held against applicator pad 44. Simultaneously, shuttle 16 moves into position at Station B such that an unlabeled article 14 is adjacent the periphery of applicator drum 28. Once applicator drum 28 has "picked up" a label at Station A, the drum rotates until the label bearing applicator pad 44 arrives at Station B. During the rotation from Station A to Station B, leading edge 12' and/or trailing edge 12" of label 12 on applicator pad 44 is detected by sensor 62. Based on the information from sensor 62, the position of shuttle 16 is moved so that the simultaneous rotation of drum 28 and linear movement of shuttle 16 cause the label to be contacted with article 14 and applied in a single fluid motion. As the label bearing pad 44 moves beyond slot 49, the vacuum at the surface of pad 44 is discontinued such that label 12 is released from drum 28 and can be smoothly applied to article 14. Applicator drum 28 continues to rotate until applicator pad 44 is in its home position, i.e., located adjacent peel plate 24 at Station A. At the same time, shuttle 16 moves so that the labeled article 14 can be removed and an unlabeled article can be mounted on shuttle 16. It has been found that the use of applicator drum 28 in conjunction with controlled shuttle 16 as described above is especially useful in the application of very thin labels because the timed rotation of drum 28 and movement of shuttle 16 prevents the formation of air bubbles between applied label 12 and article 14.

Although the invention has been described in considerable detail through the figures and above discussion, many variations and modifications can be made by one skilled in the art without departing from the spirit and scope of the invention as described in the following claims.

What is claimed is:

1. A device for applying adhesive coated, thin labels carried on a web roll in which each label has a leading edge, a trailing edge, an adhesive face and a nonadhesive face, said device comprising:

a. a label drum for holding the web roll;

b. a peel plate around which the label bearing web is guided, wherein an abrupt change in direction of the web around the peel plate initiates separation of the leading edge of a label from the web;

c. a vacuum transfer drum for picking up the separated labels at a pick-up station adjacent said peel plate and moving the labels to a transfer station, said vacuum transfer drum comprising:

i. a drum;

ii. at least one vacuum pad mounted on the periphery of said drum, said vacuum pad having a plurality of apertures;

iii. vacuum means in the interior of said drum for applying a negative pressure at the surface of said vacuum pad by way of said apertures, wherein said vacuum means applies said negative pressure only as the drum rotates between the pick-up station and the transfer station;

d. a take-up drum for receiving the web after the labels have been removed;

e. means for driving the web between said label drum and said take-up drum;

f. a shuttle for holding and moving articles to and from the transfer station, such that articles are placed in contact with labels as the labels arrive at the transfer station;

g. a first sensor for detecting the position of the shuttle;

h. a second sensor for detecting the position of the drum;

i. a third sensor for detecting when web mounted labels are in position for being picked up; and j. a fourth sensor for detecting either the leading edge or trailing edge of a label as it is held on said vacuum pad to verify the position of the label on the pad for proper alignment with the article carried by said shuttle.

2. The device of claim 1 wherein said shuttle further comprises means for adjusting the position of articles held on said shuttle relative to said shuttle.

3. The device of claim 1 wherein said shuttle is reciprocally moving.

4. The device of claim 1 wherein said fourth sensor is slidingly mounted adjacent the periphery of said vacuum transfer drum such that said fourth sensor can be slidingly moved around the periphery of said vacuum transfer drum between the pick-up station and the transfer station.

5. A method for applying adhesive coated, thin labels carried on a web to articles, each label having a leading edge, a trailing edge, an adhesive face and a nonadhesive face, said method comprising:

a. initially adjusting an article placement adjusting means to precisely place an article on a reciprocating shuttle;

b. bending a label bearing web around a peel plate to initiate separation of the leading edge of a label from the web;

c. contacting the leading edge of the separated label with a vacuum pad located on the periphery of a vacuum drum such that said vacuum pad retains said leading edge on said vacuum drum;

d. rotating said drum in conjunction with advance of said web such that the remaining portion of the label is transferred to said vacuum pad;

e. moving an article-bearing shuttle to a position adjacent said drum;

f. detecting the position of the label on said vacuum pad;

g. rotating said drum and moving said shuttle until the leading edge of the label is contacted with the article on said shuttle based on said label position detection; and h. transferring the label to the article by rotating the drum in conjunction with the advancement of said shuttle.

6. The method of claim 5 further comprising detecting the leading edge of said label with a label pick up sensor.

7. The method of claim 5 further comprising detecting the rotational position of said vacuum drum and detecting the position of said shuttle.

8. The method of claim 5 in which the movement of said article-bearing shuttle is reciprocal between a first article load/unload station and a second application station adjacent said drum.

* * * * *